United States Patent [19]

Kaswer

[11] Patent Number: 4,829,906

[45] Date of Patent: May 16, 1989

[54] CUTTING BULLET

[76] Inventor: Stanley W. Kaswer, 13 Surrey Dr., Brookfield Center, Conn. 06805

[21] Appl. No.: 93,726

[22] Filed: Sep. 8, 1987

[51] Int. Cl.[4] ..... F42B 11/10

[52] U.S. Cl. ..... 102/514; 102/508; 102/517

[58] Field of Search ..... 102/501, 507, 508, 509, 102/510, 514, 515, 516, 517, 518, 519, 529; 244/3.23

[56] References Cited

U.S. PATENT DOCUMENTS

| | | |
|---|---|---|
| 760,338 | 5/1904 | Kwiatkowski . |
| 1,448,800 | 3/1923 | Hadfield et al. . |
| 3,138,102 | 6/1964 | Meyer et al. . |
| 3,349,711 | 10/1987 | Darigo et al. . |
| 3,557,702 | 1/1971 | Benson . |
| 3,991,684 | 11/1976 | Pritchard . |

*Primary Examiner*—Deborah L. Kyle

*Assistant Examiner*—Richard W. Wendtland

*Attorney, Agent, or Firm*—Joseph R. Carvalko Jr.

[57] ABSTRACT

In certain types of firearm competition bowling pin-like objects are shot at, with the goal of knocking them off of a platform. To accomplish this with conventional bullets having a standard tapered bullet requires great skill. This invention relaxes the precision requirement by using a bullet which has a sawtooth section cut from the face of the bullet. A bullet fired from a firearm normally rotates axially due to the rifling in the gun barrel. The rotation coupled with a sawtooth edged slug causes the bullet to penetrate the bowling pin-like object by boring into the surface. The kinetic energy of the bullet's forward movement impacts the bowling pin-like object moving it away from the line of fire. The kinetic energy of the bullet's rotational moment causes the bowling pin-like object to rotate about the axis of the bullet. The composite forces cause the pin to be knocked off the platform.

1 Claim, 1 Drawing Sheet

CUTTING BULLET

BACKGROUND OF THE INVENTION

In certain kinds of firearm competition bowling pin-like objects, (herein after referred to as the "targets"), are fired at with the objective of knocking them off of a platform. The shooter stands approximately twenty-five feet from the platform upon which the objects are arranged, and upon a signal from a range officer, the shooter commences fire. The goal among competitors is to clear the targets off the platform in the shortest time. The competition tests the speed and accuracy of the shooter.

Since this form of gamesmanship began in 1975, various kinds of ammunition have been used to knock down the targets. There are considerable number of references in the main classification of ammunition and explosives. Typical of the patents is U.S. Pat. No. 1,095,501, commonly known as the hollow point bullet. The reference teaches that the bullet opens into a mushroom upon impact. The hollow point has been the most frequently used ammunition because it tends to be the most consistently successful in clearing the platform. The hollow point crushes on impact whereby the crush assumes a mushroom shape in the course of transferring its momentum over an area defined by it's surface. The problem with most slugs, including the hollow point, is that they taper down terminating in the vertex of a cone, which tends to deflect the projectile off curved surfaces such as bowling pin-like objects. This is especially true with strikes that are not directly on the vertical centerline of the target.

This invention overcomes the problem of having to strike the target substantially along the vertical centerline of the target by cutting into or boring into the target in a drilling fashion. This drilling into the target is accomplished through the spinning or rotation of the slug while airborne coupled with a pattern of serrations or sawtooths cut into the frontal section of the bullet.

SUMMARY OF THE INVENTION

A successful bullet design, where the object is to remove bowling pin-like wood targets, must eliminate or reduce the problem of deflection. Ideally the bullet should enter or contact the object or target from any angle, stop, and deliver maximum kinetic energy to the target. This invention substantially accomplishes this objective through the use of the sawtooth or serrated section cut around the frontal section of a recessed slug moving rotationally as it moves forward. The serrations are typically pitched in the direction of rotation and act as a saw or cutting edge on contact. Upon impacting the target, the pitched teeth of the sawtooth section revolving at a relatively high RPM, drills a shallow cavity in the wood target. Within a short time after impact the kinetic energy of the bullet is transferred to the target. The momentum of the bullet (velocity and direction) push the target off the platform.

This invention uses a bullet that has a sawtooth section cut from the face of the bullet. When the bullet is fired from a conventional firearm with rifling the bullet is thereby caused to rotate. Upon impact, the bullet, herein disclosed, grabs hold of the bowling pin-like object due to the shape and pitch of the cutting edge on the face of the bullet. Upon impact the rotational and the longitudinal kinetic energy of the bullet is transferred to the target rather than used in the deflection of the bullet, which is generally what occurs when a conventional bullet impacts a smoothed curved surface.

The complete slug disclosed herein comprises a core which serves both as a base and a body. The body of the bullet includes a cylindrical surface which is integral to a forward tapered surface, and a means cut into the face of the bullet to drill or bore into the target. The means cut into the face or frontal means is comprised of a plurality of cutting edges which are pitched in the direction of bullet rotation when the bullet is fired. The core itself surrounds a recess designed so as to respond in the same manner as a hollow point bullet after the bullet has cut into the surface of the target. However, the recess herein also provides a secondary function to allow for a small cylindrical section of wood to be displaced into the hollow. This cuts down on the friction forces encountered in the peripheral cutting or drilling operation as the bullet enters the target.

The bullet design found to be most successful comprises a lead core which as indicated serves as a base and as a body. Typically the lead core is a hand cast lead composition usually 6 percent antimony and 94 percent lead. The cylindrical bearing surface of the rear portion of the body is generally encapsulated in a copper jacket. The jacket is used to prevent lead streaking in the gun barrels and has no discernible affect on the target.

DRAWING

FIG. 1 is a perspective drawing of the invention herein.

DESCRIPTION OF THE PREFERRED EMBODIMENT

Figure 1:
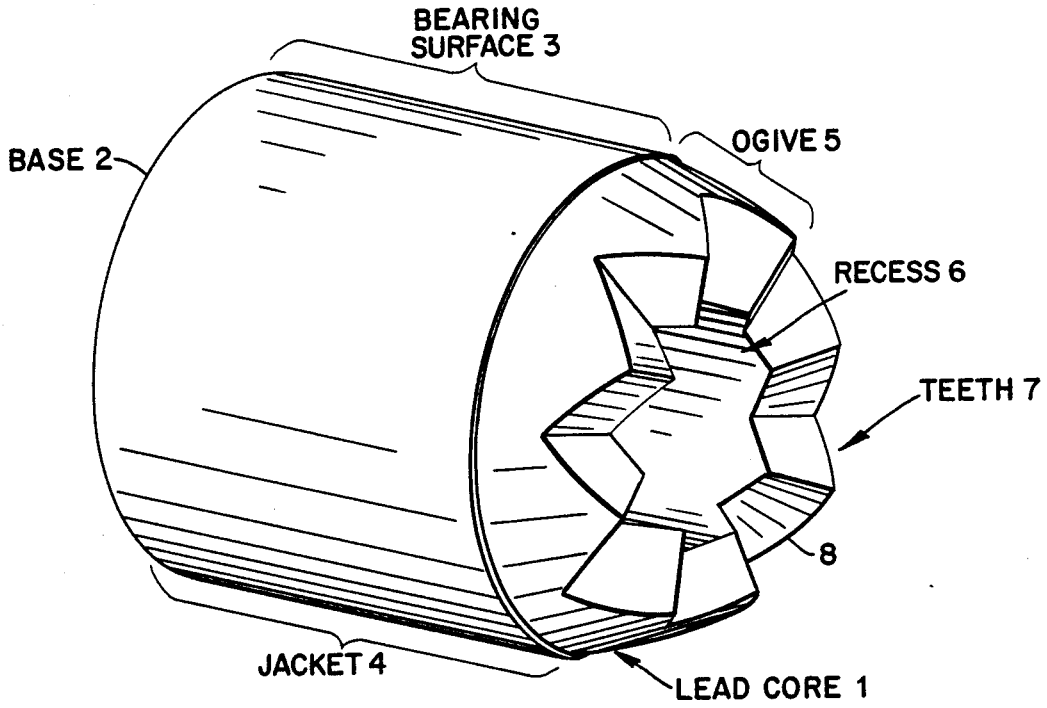

FIG. 1 illustrates the bullet or slug and the components essential to a full disclosure. The lead, core, 1 forms the main structure. There is a recess formed in the forward end of the bullet which is surrounded with a cylindrical bearing surface 3. The axial position of the recess is not critical although it must be concentric with the cylindrical geometry of the bullet.

There is shown in FIG. 1, a base 2 which defines the bottom of the bullet. The bearing surface 3 is the area which contacts or engages the rifling of the gun barrel and seals out the gases and pressure behind the base. A jacket 4 is one embodiment of a bullet and used to encapsulate the bearing surface and to prevent lead streaking in gun barrels at high muzzle velocities. There are alternative embodiments of bullets without jackets. The jacket 4 is not essential to the operation of this invention.

A tapered area 5 is denoted as the ogive. This area forms the curved frontal area of the bullet beginning approximately at the terminal end of the forward bearing surface 3. This curvature aids in feeding the bullets into semi-automatic firearms and also facilitates the smooth entry of the bullet into the forcing cone of revolvers. The ogive 5 also assists in the dynamics of the trajectory, in that it is a well known principal of projectile mechanics that a tapered projectile reduces air friction.

FIG. 1 also illustrates the plurality of pitched cutting edges. They can be described as a sawtooth frontal section 8, which is formed from teeth, which are pitched such that they form a cutting edge in the direction of rotation.

The core surrounding recess 6 serves to allow the slug to encapsulate a small cylindrical section of a wood target within its interstices as it bores or drills its way into the target. As the slug moves into the wood target, it is also rotating which applies a torque to the target, further moving it off the platform.

I claim:

1. A bullet comprising a lead core which serves as a base and a body, said body including a cylindrical bearing surface, encapsulated within a copper metal jacket, integral to a tapered forward surface extension of said core, truncated by a sawtooth section, having a plurality of sawtooth cutting edges which are pitched in the direction of rotation that occurs when the bullet is fired from a conventional firearm with rifling, wherein the core surrounds a recess such that when the bullet contacts a wood target it rotationally bores into said target displacing a small cylindrical section of wood to be disposed into said recess.

* * * * *